US007029358B2

(12) United States Patent
Ando

(10) Patent No.: US 7,029,358 B2
(45) Date of Patent: Apr. 18, 2006

(54) HERMETIC CONTAINER AND IMAGE DISPLAY APPARATUS USING THE SAME

(75) Inventor: Tomokazu Ando, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 281 days.

(21) Appl. No.: 10/602,821

(22) Filed: Jun. 25, 2003

(65) Prior Publication Data

US 2004/0001032 A1 Jan. 1, 2004

(30) Foreign Application Priority Data

Jun. 28, 2002 (JP) ..... 2002-189835

(51) Int. Cl.
*H01J 9/40* (2006.01)
*H01J 9/24* (2006.01)

(52) U.S. Cl. ..... 445/25; 445/24

(58) Field of Classification Search ..... 313/495; 445/24

See application file for complete search history.

(56) References Cited

U.S. PATENT DOCUMENTS 4,106,401 A 8/1978 Ackeret
4,125,064 A 11/1978 Ackeret
4,530,277 A 7/1985 Matsumoto
4,711,167 A 12/1987 Sano
5,461,969 A 10/1995 Cretsinger
6,109,994 A * 8/2000 Cho et al. ..... 445/25
6,138,556 A 10/2000 Yu et al.
6,722,937 B1 * 4/2004 Ludwig et al. ..... 445/25

FOREIGN PATENT DOCUMENTS

| | | |
|---|---|---|
| CN | 1341944 | 3/2002 |
| CN | 1404022 A | 3/2003 |
| EP | 1 077 464 A1 | 2/2001 |
| JP | 8-83578 | 3/1996 |
| JP | 09-283059 | 10/1997 |
| JP | 2002-083535 | 3/2002 |
| JP | 2002-125847 | 5/2002 |
| JP | 2000-311630 | 11/2003 |
| WO | 2000 51155 | 8/2000 |

* cited by examiner

*Primary Examiner*—Mariceli Santiago
(74) *Attorney, Agent, or Firm*—Fitzpatrick, Cella, Harper & Scinto

(57) ABSTRACT

A hermetic container used by an image display apparatus or the like is constituted of confronting substrates which are fixed together by a reinforcing member, and an inner space between the substrates is sealed by a sealing member. The reinforcing member is spaced apart from the sealing member to prevent breakage of the hermetic container to be caused by a difference between thermal expansion coefficients of materials.

4 Claims, 8 Drawing Sheets

ENLARGED SECTIONAL VIEW OF FRAME SECTION OF EMBODIMENT 1

SCHEMATICALLY PERSPECTIVE AND PARTIALLY SECTIONAL VIEW OF ENVELOPE OF EMBODIMENT 1

ENLARGED SECTIONAL VIEW OF FRAME SECTION OF EMBODIMENT 1

SECTIONAL VIEW OF STRUCTURE AT THE TIME OF BEING MANUFACTURED (EMBODIMENT 1)

SECTIONAL VIEW OF STRUCTURE AT THE TIME OF BEING MANUFACTURED (EMBODIMENT 1)

SECTIONAL VIEW OF STRUCTURE AT THE TIME OF BEING MANUFACTURED (EMBODIMENT 1)

ENLARGED SECTIONAL VIEW OF FRAME SECTION (EMBODIMENT 2)

ENLARGED SECTIONAL VIEW OF FRAME SECTION (EMBODIMENT 2)

HERMETIC CONTAINER AND IMAGE DISPLAY APPARATUS USING THE SAME

BACKGROUND OF THE INVENTION

1. Field of the Invention

The present invention relates to a hermetic container capable of maintaining both inner and outer different atmospheres, and to an image display apparatus using the hermetic container.

2. Related Background Art

A conventional envelope capable of maintaining an inner vacuum depressurized state is manufactured by bonding a face plate (a phosphor substrate) a rear plate (an electron-emitting device substrate) and an outer frame with bonding material frit (low melting point glass).

More specifically, a frit layer is formed in a bonding region and then baked to hermetically seal the bonding region and form an envelope capable of maintaining an inner vacuum state. For sealing and bonding glass members by using frit, it is necessary to perform a high temperature baking process at 400 to 500° C. in an atmospheric state (at an atmospheric pressure).

An image display apparatus utilizing electrons generally requires: an envelope capable of maintaining a vacuum (depressurized) atmosphere and being constituted of a face plate, a rear plate and an outer frame, respectively made of glass; an electron source for emitting electrons; a drive circuit for driving the electron source; an image display member having phosphor or the like which emits light upon collision of electrons; an acceleration electrode for accelerating electrons toward the image display member; a high voltage source for applying a high voltage to the acceleration electrode; and the like.

The detailed technology regarding such an image display apparatus is disclosed, for example, in Japanese Patent Application Laid-open No. 8-83578.

FIG. 18 (Seventh Embodiment) of International Application Laid-open Publication WO 00/51155 is shown in FIG. 8. FIG. 8 is a partial sectional view showing a peripheral area of an envelope. In FIG. 8, an electron source 1 is constituted of a plurality of surface conduction electron-emitting devices disposed on a substrate and properly wired together. A rear plate 2 and a face plate 4 are bonded to bonding areas of an outer frame 3 by using adhesive 9 and sealing members 14.

The sealing members 14 in the bonding areas seal the spaces between the rear plate 2 and outer frame 3 and between the face plate 4 and outer frame 3, by molding an In wire or In sheet in a predetermined shape and heating it at 160° C. or higher to soften In. Thereafter, the adhesive 9 is filled in the space between the rear plate 2 and face plate 4, covering the outer periphery of the In sealing members 14 and the outer frame 3.

SUMMARY OF THE INVENTION

It is an object of the invention to realize a high reliability of a hermetic container by providing a good hermetic performance.

It is another object of the invention to provide an image display apparatus capable of displaying a high fidelity image.

The invention provides a hermetic container comprising: first and second substrates disposed confronting with each other; a sealing member disposed in contact with each of the first and second substrates for maintaining hermetic an internal space between the first and second substrates; and a reinforcing member for coupling the first and second substrates, the reinforcing member being disposed spaced apart from a contact area between the sealing member and each of the first and second substrates.

The invention provides a hermetic container comprising: first and second substrates disposed confronting with each other; an outer frame disposed between the first and second substrates; a sealing member for sealing a space between one of the first and second substrates and the outer frame, the sealing member maintaining hermetic an internal space between the first and second substrates; and a reinforcing member for coupling the first and second substrates, the reinforcing member being disposed spaced apart from a contact area between the sealing member and one of the first and second substrates.

The invention provides a hermetic container comprising: first and second substrates disposed confronting with each other; an outer frame disposed between the first and second substrates; a sealing member for sealing a space between one of the first and second substrates and the outer frame, the sealing member maintaining hermetic an internal space between the first and second substrates; and a reinforcing member for coupling the first and second substrates, the reinforcing member being disposed spaced apart from a contact area between the sealing member and the outer frame.

The invention provides a hermetic container comprising: a first substrate; a second substrate disposed confronting with the first substrate; an outer frame disposed between the first and second substrates and surrounding a space between the first and second substrates; a sealing member for sealing a connection area between the outer frame and at least one of the first and second substrates, a space defined by the first and second substrates and the outer frame being maintained hermetic; and a reinforcing member disposed outside the space maintained hermetic and between the first and second substrates, the reinforcing member maintaining a fixed state of a relative position of the first and second substrates, wherein the reinforcing member does not contact a contact area between the outer frame and the sealing member.

The invention provides a hermetic container comprising: a first substrate; a second substrate disposed confronting with the first substrate; an outer frame disposed between the first and second substrates and surrounding a space between the first and second substrates; a sealing member for sealing a connection area between the outer frame and at least one of the first and second substrates, a space defined by the first and second substrates and the outer frame being maintained hermetic; and a reinforcing member disposed outside the space maintained hermetic and between the first and second substrates, the reinforcing member maintaining a fixed state of a relative position of the first and second substrates, wherein the reinforcing member does not contact a contact area between at least one of the first and second substrates and the sealing member.

The invention provides an image display apparatus having image display means disposed in the hermetic container.

DESCRIPTION OF THE PREFERRED EMBODIMENTS

Figure 1:
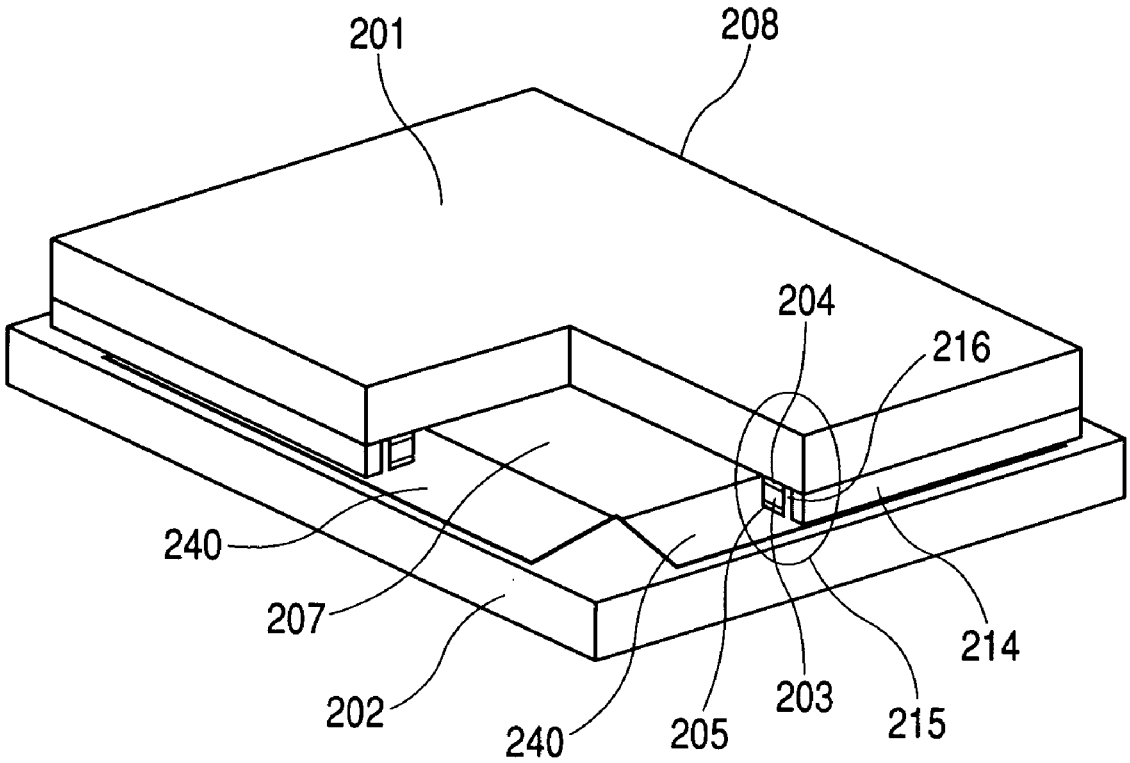
FIG. 1 is a schematic perspective illustrating the structure of a hermetic container according to a first embodiment.

The invention provides a hermetic container comprising: first and second substrates disposed confronting with each other; a sealing member disposed in contact with each of the first and second substrates for maintaining hermetic an internal space between the first and second substrates; and a reinforcing member for coupling the first and second substrates, the reinforcing member being disposed spaced apart from a contact area between the sealing member and each of the first and second substrates.

In the hermetic container described above, it is preferable that the reinforcing member coupling the first and second substrates is disposed outside of the sealing member.

The invention provides a hermetic container comprising: first and second substrates disposed confronting with each other; an outer frame disposed between the first and second substrates; a sealing member for sealing a space between one of the first and second substrates and the outer frame, the sealing member maintaining hermetic an internal space between the first and second substrates; and a reinforcing member for coupling the first and second substrates, the reinforcing member being disposed spaced apart from a contact area between the sealing member and one of the first and second substrates.

In the hermetic container described above, it is preferable that the reinforcing member coupling the first and second substrates is disposed outside the outer frame.

The invention provides a hermetic container comprising: first and second substrates disposed confronting with each other; an outer frame disposed between the first and second substrates; a sealing member for sealing a space between one of the first and second substrates and the outer frame, the sealing member maintaining hermetic an internal space between the first and second substrates; and a reinforcing member for coupling the first and second substrates, the reinforcing member being disposed spaced apart from a contact area between the sealing member and the outer frame.

In the hermetic container described above, it is preferable that the reinforcing member coupling the first and second substrates is disposed outside of the outer frame.

In the hermetic container described above, it is preferable that the reinforcing member coupling the first and second substrates is spaced apart from a contact area between the sealing member and the one of the first and second substrates.

In the hermetic container described above, it is preferable that the reinforcing member coupling the first and second substrates is disposed outside of the outer frame.

The invention provides an image display apparatus having image display means disposed in the hermetic container.

In the image display apparatus described above, it is preferable that the image display means includes an electron source and a phosphor member for emitting light upon collision of electrons emitted from the electron source.

A hermetic container according to the invention comprises: a first substrate; a second substrate disposed confronting with the first substrate; an outer frame disposed between the first and second substrates and surrounding a space between the first and second substrates; a sealing member for sealing a connection area between the outer frame and at least one of the first and second substrates, a space defined by the first and second substrates and the outer frame being maintained hermetic; and a reinforcing member disposed in an outside of the space maintained hermetic between the first and second substrates, the reinforcing member maintaining a fixed state of a relative position of the first and second substrates, wherein the reinforcing member does not contact a contact area between the outer frame and the sealing member.

The structure of the hermetic container of the invention is effective, among other things, when the reinforcing member, outer frame and sealing member have different thermal expansion coefficients. If the thermal expansion coefficients of the reinforcing member, outer frame and sealing member are different, it is desired that the reinforcing member, outer frame and sealing member do not contact in common (a triple point is not formed). However, if reinforcement near in some region is sufficient, the reinforcing member may contact both the outer frame and sealing member. Another reinforcing member may be used which has a thermal expansion coefficient approximately equal to that of at least one of the outer frame and sealing member. The other reinforcing member may contact the contact area where the sealing member and outer frame contact each other.

A hermetic container according to the invention, comprises: a first substrate; a second substrate disposed confronting with the first substrate; an outer frame disposed between the first and second substrates and surrounding a space between the first and second substrates; a sealing member for sealing a connection area between the outer frame and at least one of the first and second substrates, a space defined by the first and second substrates and the outer frame being maintained hermetic; and a reinforcing member disposed in an outside of the space maintained hermetic between the first and second substrates, the reinforcing member maintaining a fixed state of a relative position of the first and second substrates, wherein: the reinforcing member does not contact a contact area between at least one of the first and second substrates and the sealing member.

This invention is particularly effective if the thermal expansion coefficients of the reinforcing member, sealing member and substrate in contact with the sealing member (at least one of the first and second substrates) are different. It is desired that the reinforcing member, sealing member and substrate in contact with the sealing member do not contact in common. Similar to the first-mentioned invention, a reinforcing member partially contacting both the sealing member and substrate in contact with the sealing member may be used, and a combination with another reinforcing member may be used.

An image display apparatus achieving the above-described objects of the invention uses the hermetic container wherein one of the first and second substrates has an electron source and the other has a phosphor member for emitting light upon collision of electrons emitted from the electron source.

The invention described above has been made on the basis of the following knowledge.

While an image is displayed on an image display apparatus such as that shown in FIG. 18 of International Application Laid-open Publication WO 00/51155, heat is generated in the electron source 1 or phosphor member 7 and there may be a temperature difference between the face plate 4 and rear plate 2. In this case, there is a difference between the thermal expansion amounts of the face plate 4 and rear plate 2, and a sharing force caused by the thermal expansion difference is applied to the frame section (mainly outer frame 3 and adhesive member 9) at the periphery of the envelope. As the frame section is deformed by the shearing force applied thereto, the relative position of the face plate 4 and rear plate 2 changes so that the radiation position of an electron beam emitted from the electron source may displace from the center position of the phosphor member 7 and the image quality may be degraded. Displacement of the relative position of the face plate 4 and rear plate 2 is required to be suppressed in order to obtain a high fidelity image on the image display apparatus.

The adhesive member 9 is required to provide not only the adhesion function but also the reinforcing function of more firmly bonding the face plate 4 and rear plate 2. While the reinforcing structure has been studied by using adhesive having a high elasticity strength and a high breakage strength as the material of the adhesive member 9, the following points have been found.

Figure 8:
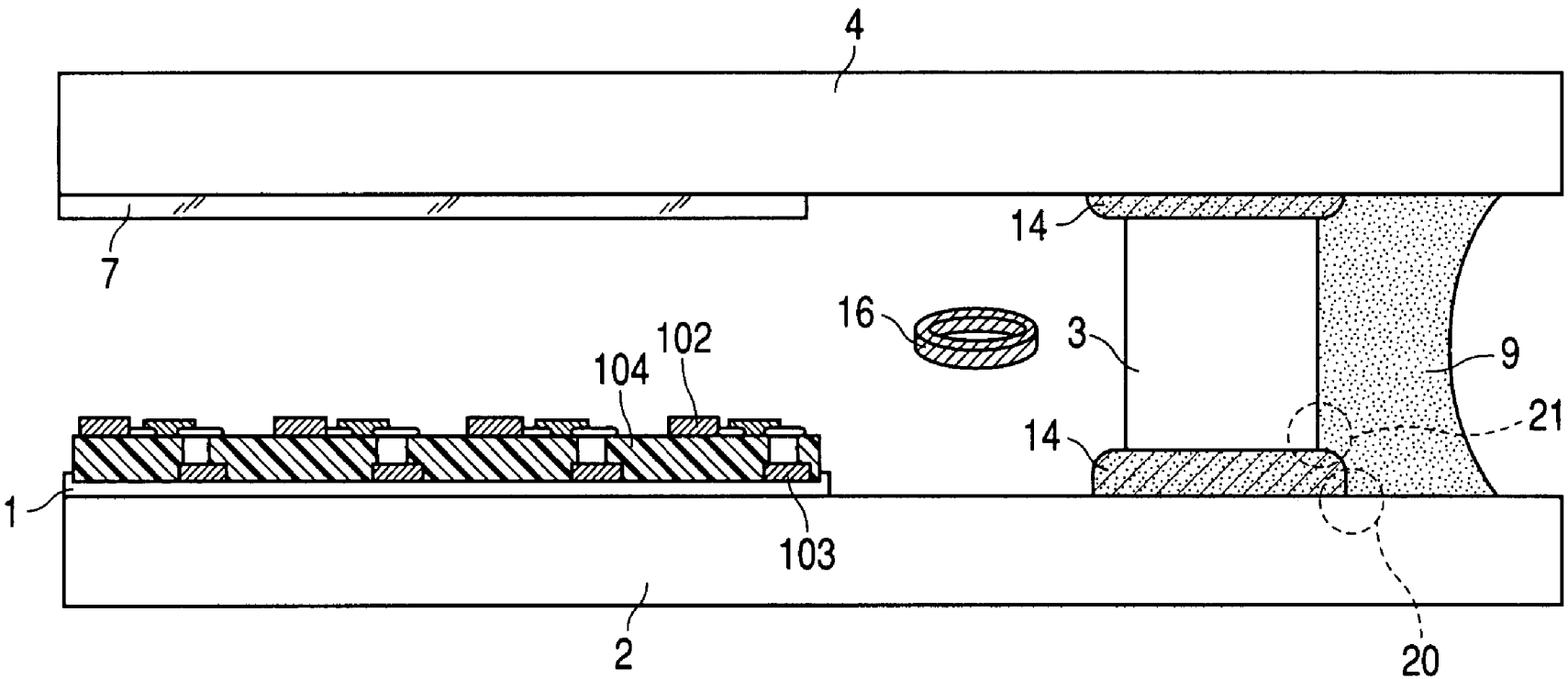
FIG. 8 is an enlarged sectional view illustrating a conventional frame section.

A reliability test was performed by giving a temperature difference, which is a threefold of a generally expected temperature difference, between the face plate 4 and rear plate 2, two breakages occurred starting from two triple points shown in FIG. 8. As shown in FIG. 8, in the conventional structure, three different materials, the sealing material 14, rear plate 2 and adhesive member 9, contact at a triple point 20, whereas three different materials, the sealing material 14, outer frame 3 and adhesive member 9, contact at a triple point 21. Namely, at the triple point where three different materials having different material physical values such as an elastic modulus and a thermal expansion coefficient contact together, a complicated large stress is generated by residual stress during manufacture and a temperature load during a reliability test. It has been found that as the adhesive member 9 is made to have a higher strength, the stress concentration becomes greater and a breakage possibility becomes higher. FIG. 8 is a sectional view, and because the description is given with reference to FIG. 5, the points 20 and 21 are called triple points. If the depth direction is taken into consideration, they are actually called triple lines.

Existence of such a triple point limits greatly the selection of materials of the adhesive member 9 and sealing member 14. Namely, apparatus designs are greatly limited, for example, it is difficult to select adhesive having a high strength as the material of the adhesive member 9, or even if adhesive having a lower cost is used to be used as the material of the adhesive member 9, it becomes necessary to more carefully perform a reliability test because of existence of a triple point.

Under such a circumstance, according to the present invention, the reinforcing member coupling the confronting first and second substrates appropriately fixes the relation position of the first and second substrates and is structured not to form a triple point. Therefore, the selection range of materials can be broadened while the reliability of the hermetic container is maintained high, the first and second substrates can be fixed more firmly, and a higher fidelity image display apparatus can be manufactured.

The details of the invention will be given in the following.

By reducing the number of triple points, quadruple points or more, the material selection range of the reinforcing member (e.g., adhesive to be later described) can be broadened while the reliability of the hermetic container is maintained high. From this viewpoint, in the hermetic container of this invention, the reinforcing member is disposed not to contact the contact or bonding area between the outer frame and sealing member. The outer frame is disposed between the first substrate and the second substrate confronting with the first substrate, and surrounds the periphery of the hermetic container. The sealing member seals the space between the outer frame and at least one of the first and second substrates.

The reinforcing member may be disposed so as not to contact the contact area between the first substrate and sealing member and/or between the second substrate and sealing member.

The reinforcing member of the most preferable hermetic container is disposed so as not to contact the contact area between the outer frame and sealing member, a contact area between the first substrate and sealing member and a contact area between the second substrate and sealing member.

In the following description, the hermetic container is used with the image display apparatus, and the first substrate is called a face plate and the second substrate is called a rear plate. These terms may be used reversely.

The materials of the first and second substrates and the outer frame constituting the hermetic container are glass for example. Glass materials such as high strain point glass, soda lime glass, quartz glass and the like may be used without any problem.

The material of the sealing member which provides a sealing function may be selected from a group consisting of: metal or alloy such as In, Al, Cu, Au, Ag, Pt, Ti and Ni; and organic or inorganic adhesive whose surface is coated with metal or alloy such as In, Al, Cu, Au, Ag, Pt, Ti and Ni. Low melting point metal having a melting point of 400° C. or lower is preferable. For example, such material includes:

metal such as In, Pb and Sn; so-called solder material containing Pb, Sn, In, Au or the like; and low/middle solder material of a Bi-series, Sn—Pb series, Sn—Zn series, Cd—Zn series or Zn—Al series.

The thermal expansion coefficient of the reinforcing member may be different from those of the outer frame and sealing member, or may be the same as that of at least one of the outer frame and sealing member.

Adhesive may be used as the material of the reinforcing member. Usable adhesive includes: high polymer thermoplastic adhesive whose main component is polyetherketone, polysulfone or the like; adhesive whose main component is polybenzo-imidazol; adhesive whose main component is acrylic resin; adhesive whose main component is polyimide resin; organic adhesive such as adhesive whose main component is epoxy resin; and inorganic adhesive whose main component is one, two or more (including composite oxide) of alumina, silica, zirconia and carbon. Most suitable adhesive is inorganic adhesive whose main components are zirconia and silica or inorganic adhesive whose main components are silica and alumina (including silica-alumina).

In order to maintain a gap between the first and second substrates, adhesive repulsing the force of moving away the first and second substrates may be used, or adhesive repulsing the force of attracting the first and second substrates may be used.

An image display apparatus can be manufactures by disposing an electron source on one of the first and second substrates of the hermetic container and a phosphor member on the other substrate which emits light upon collision of electrons emitted from the electron source.

The invention will be described in more detail with reference to the preferred embodiments which are illustratively shown and do not limit the scope of the invention.

(First Embodiment)

FIGS. 1 to 4 are diagrams to be used for describing the first embodiment of the invention.

Figure 2:
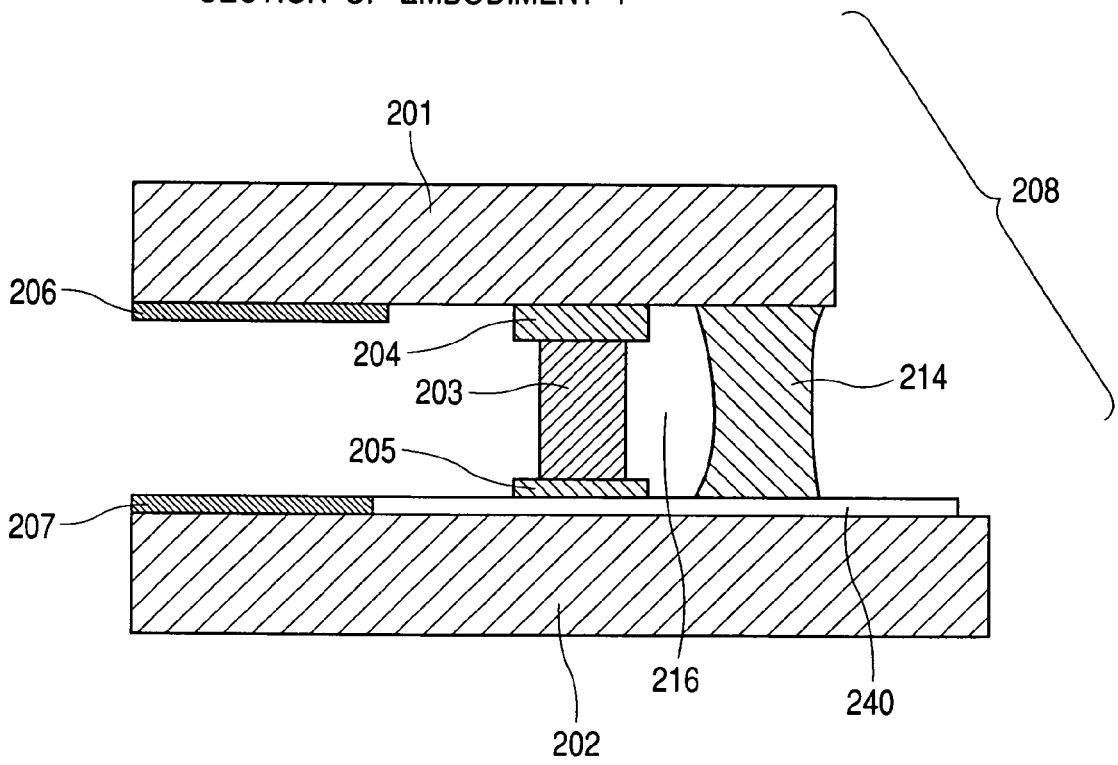
FIG. 2 is an enlarged sectional view illustrating a frame section of the first embodiment.

FIG. 1 is a schematic perspective illustrating the overall structure of a hermetic container. FIG. 2 is an enlarged sectional views of a section denoted by 215 in FIG. 1.

Referring to FIGS. 1 and 2, a face plate 201 has a phosphor member 206 mounted thereon, and a rear plate 202 has an electron source 207 and a wiring lead portion 240 mounted thereon. The electron source 207 is a collective term standing for a plurality of surface conduction electron-emitting devices, wiring lines necessary for driving the devices, insulating layers and the like. The wiring lead portion 240 is a collective term standing for wiring lines for externally supplying an electric signal and the like to the electron source 207, insulating layers and the like. The phosphor member 206 is a collective term standing for phosphor, an electrode for accelerating electrons and the like.

An outer frame 203 is disposed between the face plate 201 and rear plate 202. A sealing member 204 is made of alloy of In (97%)—Ag (3%) and seals a space between the face plate 201 and outer frame 203. A space between the rear plate 202 and outer frame 203 is sealed by a frit member 205. Sealing is intended to mean maintaining a vacuum hermetic state.

An adhesive member 214 is disposed in a region between the face plate 201 and the wiring lead portion 240 formed on the rear plate 202, and in a region outside of the outer frame 203. A space 216 is disposed in a region between the face plate 201 and the wiring lead portion 240 formed on the rear plate 202, and in a region between the sealing member 204, outer frame 203 and frit member 205 and the adhesive member 214.

Since the space 216 exists, a reinforcing structure does not contact a bonding area between the outer frame and sealing member, and does not contact a bonding area between the sealing member and at least one of the first and second substrates.

The material of the face plate 201, rear plate 202 and outer frame 203 is PD200 (manufactured by Asahi Glass Company) which is high strain point glass. The frit member is made of ASF2300M (manufactured by Asahi Glass Company) and the sealing condition is 10 minutes at 430° C. A thermal expansion coefficient of PD200 is $83\times10^{-7}$/° C. and that of ASF2300M is $72\times10^{-7}$/° C. A thermal expansion coefficient of In—Ag alloy is $25\times10^{-6}$/° C.

Figure 3:
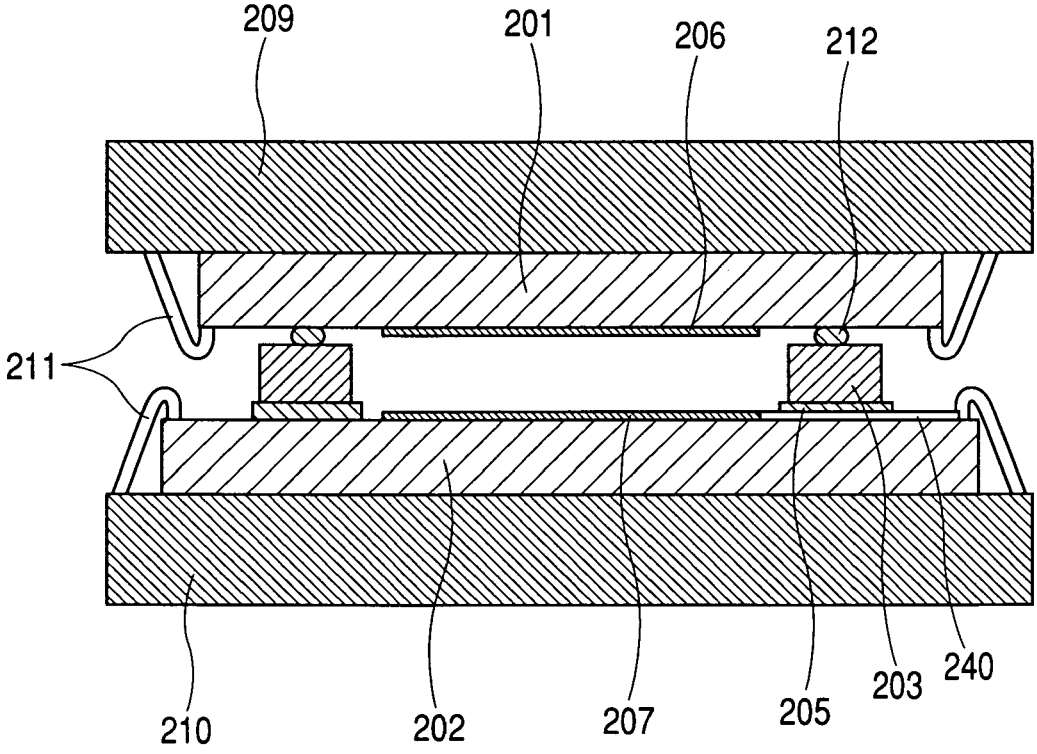
FIG. 3 is a sectional view illustrating a method of manufacturing the hermetic container of the first embodiment.
Figure 4:
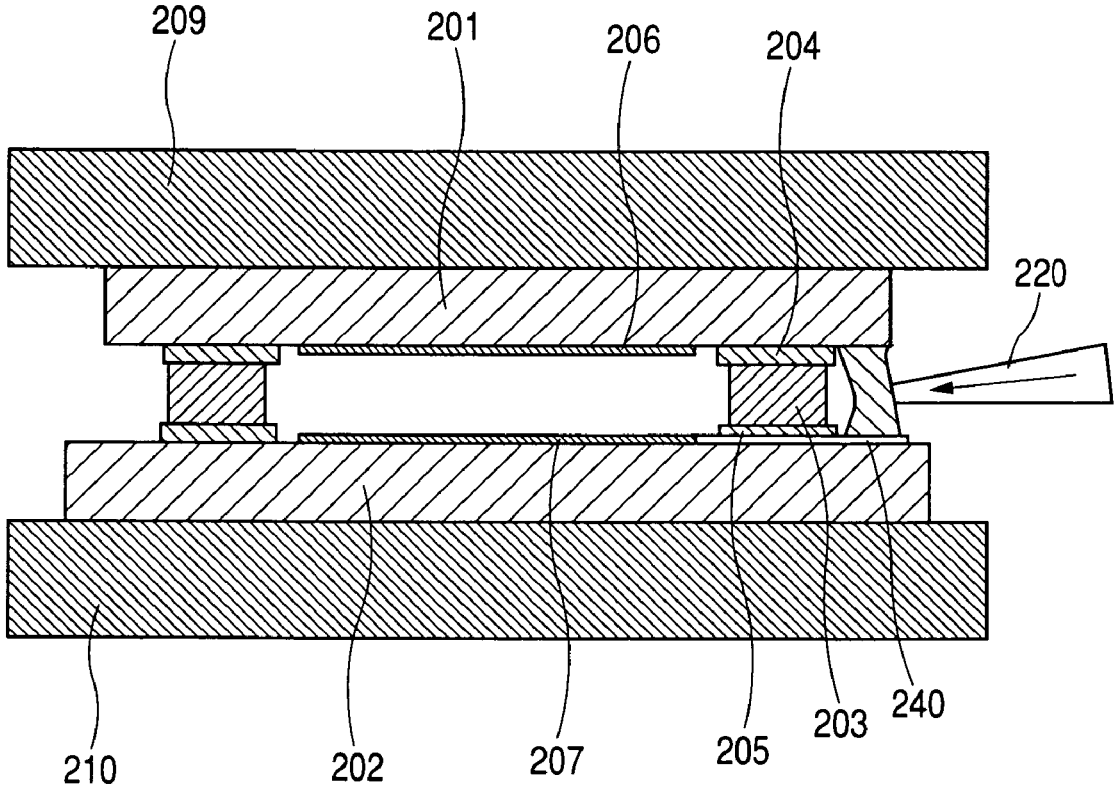
FIG. 4 is a sectional view illustrating a method of manufacturing the hermetic container of the first embodiment.
Figure 5:
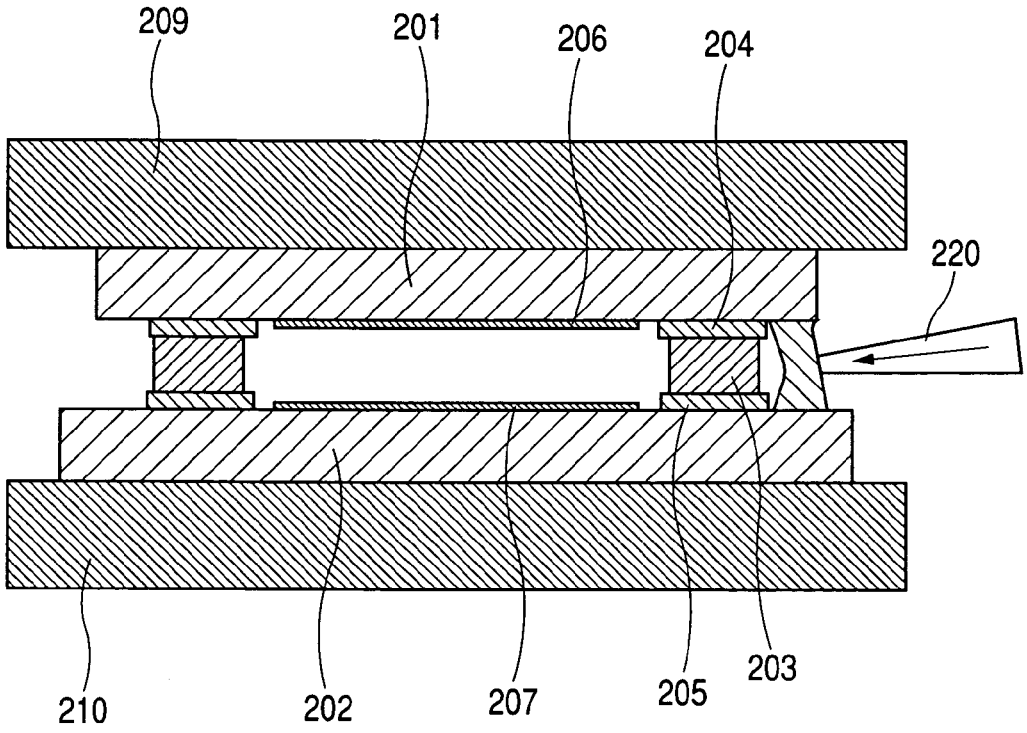
FIG. 5 is an enlarged sectional view illustrating the frame section of the first embodiment.

The sectional views of FIGS. 3 to 5 show the structures of the hermetic container during manufacture. In FIGS. 3 to 5, reference numeral 209 represents a rear plate hot plate for heating the rear plate, and reference numeral 210 represents a face plate hot plate for heating the face plate. Fixing members 211 are used for fixing the rear plate 202 and face plate 201 to the hot plates. An InAg alloy wire 212 made of alloy of In (97%)—Ag (3%) is baked at 141° C., which is a melting point of InAg, or higher to form the sealing member 204. A dispenser 202 is used for coating the adhesive member 214.

First, the rear plate 202, formed with the electron source 207, wiring lead portion 240 and the like and the outer frame 203 sealed with the frit member 205, is placed on the rear plate hot plate 210 and fixed to the hot plate by the fixing members 211.

Next, the InAg alloy wire 212 of low melting point metal, curved into the same shape as that of the outer frame 203, is placed on the outer frame 203, and the face plate 201, formed beforehand with the phosphor member 206, is fixed to the face plate hot plate 209 with the fixing members 211 and stacked on the InAg alloy wire 212, with the phosphor member 206 being made to confront with the electron source 207.

Thereafter, the rear plate 202 and face plate 201 are aligned at desired positions and fixed by using a positioning mechanism (not shown), and then the hot plates 209 and 210 are heated to 150° C. in excess of the melting point of the InAg alloy wire 212 to melt the InAg alloy wire 212 and thereafter cool the melted alloy. At the stage of cooling the hot plates 209 and 210, the InAg alloy wire 212 is hardened and becomes the sealing member 204 which provides the hermetic function.

In order to improve the tight adhesion between the outer frame 203 and face plate 201 and the InAg alloy wire 212, it is effective that metal such as In and Ag or InAg alloy is coated in advance on the bonding area by vacuum vapor deposition, coating such as screen printing, dipping, spraying, and dispensing, or the like.

After the hot plates 209 and 210 are cooled, the fixing members 211 are removed and then the adhesive member 214 is coated with the dispenser 220.

Used as the adhesive member 214 was inorganic adhesive having silica alumina as its main component (Sumiceram-S: manufactured by Asahi Chemical Co., Ltd). A thermal expansion coefficient of Sumiceram-S is $70\times10^{-7}$/° C. When the adhesive member 214 is coated with the dispenser 220, the position of a tip of the dispenser and a viscosity of the adhesive member are adjusted to form the space 216. Even if the adhesive member extends outward relative to the hermetic container, this poses no strict problem and the adhesive member 214 may be made flush with the side surface of the face plate 201.

After the adhesive member 214 is coated, the hot plates 209 and 210 are again heated to perform baking for 30 minutes at 100° C. and harden the adhesive member 214. Thereafter, the hot plates are cooled to complete reinforcing the hermetic container 208.

In the region of the rear plate 202 in which the wiring lead portion does not exist, the adhesive member 214 is coated directly on the rear plate 202 as shown in FIG. 5.

Next, the hermetic container 208 is dismounted from the hot plates 209 and 210 and the like. A vacuum exhaust pipe (not shown) of the hermetic container 208 is coupled to an external vacuum exhaust apparatus to lower the inner pressure of the hermetic container 208 to $1\times10^{-3}$ Pa or lower. Thereafter, as disclosed in Japanese Patent Application Laid-open NO. 8-83578 or the like, the electron source 107 is subjected to an energization operation such as a forming operation and an activation operation. Then, the vacuum exhaust pipe is heated with a burner to cut and seal it and complete the hermetic container in the vacuum state (depressurized state).

A driver apparatus such as a driver board for driving the electron source 207 and the like, a high voltage source for supplying a high voltage to accelerate electrons emitted from the electron source 207 and the like were mounted on the hermetic container 208 to complete an image display apparatus, and image display was confirmed.

In this embodiment, although a surface conduction electron-emitting device is used as the electron source 207, the invention is not limited only thereto, but a cold cathode electron-emitting device, such as an electric field emission type and a carbon nano tube type, may also be used without any practical problem.

In this embodiment, it is obvious that the same member as the sealing member 204 may be used in place of the frit member 205.

According to the invention, since the image display apparatus is relatively small, an atmospheric pressure support structure called a spacer is not necessary. However, if a hermetic container for a large screen image display apparatus is to be manufactured, a support body called a spacer is provided between the face plate 201 and rear plate 202 in order to suppress the deformation of the face plate 201 and rear plate 202 to be caused by an atmospheric pressure. In this manner, a hermetic container having a sufficient strength against the atmospheric pressure can be configured.

The effects of the invention are not limited only to a hermetic container having a cold cathode electron-emitting device and an image display apparatus, but are also applicable to a plasma discharge type image display apparatus (PDP). In the latter case, the rear plate is formed with partition walls and the face plate is formed with a discharge electrode and the like. Discharge gas is filled in the space between the rear plate and face plate.

A radiation position of an electron beam on the phosphor 206 during image display was measured by heating the face plate 201 of the hermetic container 208 with a plane type heater attached to the outer surface of the face plate 201 to raise the temperature of the face plate to a threefold of a normal temperature of the rear plate 202. A displacement of the radiation position of the electron beam was not observed and the image quality was neither degraded. Confirmed were the effects that the face plate 201 and rear plate 202 are firmly fixed by the adhesive member 214 via the wiring lead portion 240.

Any breakage of the adhesive member 214 was not observed. It was confirmed that since the space 216 is formed, a triple point does not exist so that intrinsic defects of the hermetic container can be removed and the reliability of the hermetic container and image display apparatus can be improved.

(Second Embodiment)

Figure 6:
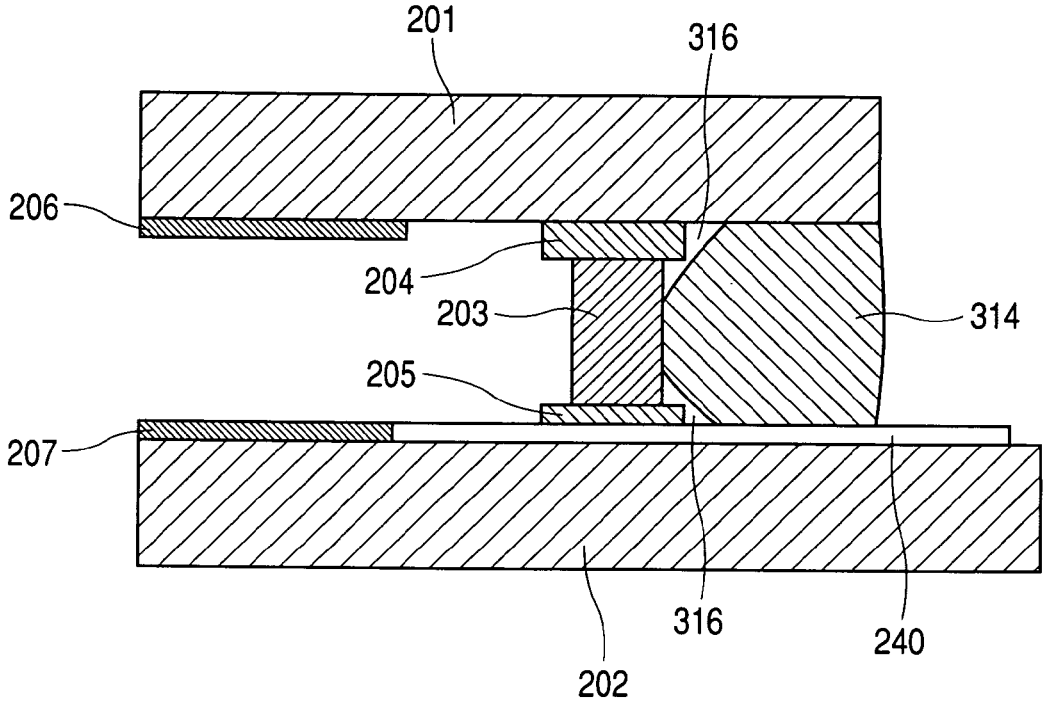
FIG. 6 is an enlarged sectional view illustrating a frame section according to a second embodiment.
Figure 7:
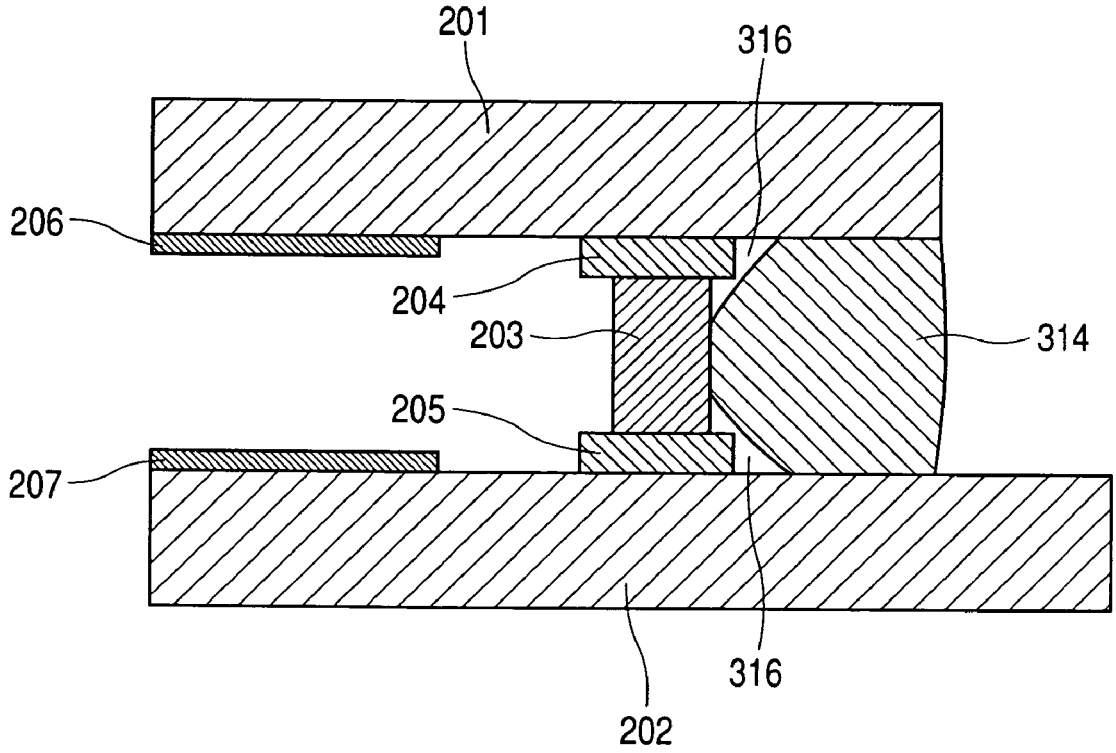
FIG. 7 is an enlarged sectional view illustrating the frame section of the second embodiment.

FIGS. 6 and 7 are diagrams to be used for describing the second embodiment of the invention.

FIG. 6 is an enlarged sectional view showing the structure of the region where the wiring lead portion 240 exists, and FIG. 7 is an enlarged sectional view showing the structure of the region where the wiring lead portion 240 does not exist. The structure of the second embodiment is different from the first embodiment only in the structure of the adhesive member. The materials used in the second embodiment were the same as those of the first embodiment.

Referring to FIG. 6, an adhesive member 314 is formed between the face plate 201 and rear plate 202 and in the region outside of the outer frame 203. In this embodiment, although the adhesive member 314 contacts the outer frame 203, it does not contact the sealing member 204 and frit member 205 because of the existence of spaces 316, so that a triple point does not exist.

In this embodiment, the spaces 316 can be formed by coating the adhesive member 314 having a high viscosity with a dispenser.

By suppressing the frit member 205 and sealing member 204 from extending to the outside of the outer frame 203 by reducing the amounts of materials of the frit member 205 and sealing member 204, the spaces 316 can be formed more easily.

Also in this embodiment, the effects similar to those of the first embodiment were obtained.

According to the structures of the embodiments described above, in the reinforcing structure that the adhesive member is placed between the face plate and rear plate, a contact point of three or more different materials is not formed so that the selection range of the material of the adhesive member can be broadened and the face plate and rear plate can be firmly fixed. By removing stress concentration points, the intrinsic strength can be increased so that a more precise image display apparatus can be manufactured.

The invention can maintain the reliability of a hermetic container by providing a good hermetic function.

The invention can also provide an image display apparatus capable of displaying a high fidelity image.

The invention can also realize a suitable hermetic container or image display apparatus by reducing the number of stress concentration points.

What is claimed is:

1. A hermetic container, comprising:

a first substrate;

a second substrate disposed confronting with said first substrate;

an outer frame disposed between said first and second substrates and surrounding a space between said first and second substrates;

a sealing member for sealing a connection area between said outer frame and at least one of said first and second substrates, a space defined by said first and second substrates and said outer frame being maintained hermetic; and a reinforcing member disposed outside the space maintained hermetic and between said first and second substrates, said reinforcing member maintaining a fixed state of a relative position of said first and second substrates, wherein:

said reinforcing member does not contact an area at which said outer frame and said sealing member contact mutually, and said reinforcing member consists of an adhesive for adhering said first and second substrates, wherein said reinforcing member, said outer frame and said sealing member have different thermal expansion coefficients.

2. A hermetic container, comprising:

a first substrate;

a second substrate disposed confronting with said first substrate;

an outer frame disposed between said first and second substrates and surrounding a space between said first and second substrates;

a sealing member for sealing a connection area between said outer frame and at least one of said first and second substrates, a space defined by said first and second substrates and said outer frame being maintained hermetic; and a reinforcing member disposed outside the space maintained hermetic, and between said first and second substrates, said reinforcing member maintaining a fixed state of a relative position of said first and second substrates, wherein:

said reinforcing member does not contact an area at which at least one of said first and second substrates contacts said sealing member, and said reinforcing member consists of an adhesive for adhering said first and second substrates, wherein said reinforcing member, at least one of said first and second substrates and said sealing member have different thermal expansion coefficients.

3. A hermetic container according to claim 1, wherein said sealing member is made of low melting point metal.

4. A hermetic container according to claim 1, wherein said sealing member is made of frit.

* * * * *

UNITED STATES PATENT AND TRADEMARK OFFICE

CERTIFICATE OF CORRECTION

PATENT NO. : 7,029,358 B2
APPLICATION NO. : 10/602821
DATED : April 18, 2006
INVENTOR(S) : Tomokazu Ando It is certified that error appears in the above-identified patent and that said Letters Patent is hereby corrected as shown below:

ON TITLE PAGE AT (56) FOREIGN PATENT DOCUMENTS

"2000-311630 11/2003" should read --2000-311630 11/2000--; and
"2000 51155 8/2000" should read --2000/51155 8/2000--.

COLUMN 6

Line 18, "is used" should read --is--.

COLUMN 7

Line 38, "manufactures" should read --manufactured--; and
Line 52, "views" should read --view--.

Signed and Sealed this

Fourteenth Day of November, 2006

JON W. DUDAS
*Director of the United States Patent and Trademark Office*